US012245663B2

(12) United States Patent
Xu et al.

(10) Patent No.: US 12,245,663 B2
(45) Date of Patent: Mar. 11, 2025

(54) TEMPERATURE-ADJUSTMENT SHOE SOLE

(71) Applicants: Zhimin Xu, Guangzhou (CN); Chucan Guo, Guangzhou (CN)

(72) Inventors: Zhimin Xu, Guangzhou (CN); Chucan Guo, Guangzhou (CN)

(73) Assignee: Guangzhou Zhengtao Enterprise Management Co., Ltd., Guangdong (CN)

( * ) Notice: Subject to any disclaimer, the term of this patent is extended or adjusted under 35 U.S.C. 154(b) by 0 days.

(21) Appl. No.: 18/914,070

(22) Filed: Oct. 12, 2024

(65) Prior Publication Data

US 2025/0031802 A1 Jan. 30, 2025

(51) Int. Cl.

| | |
|---|---|
| ***A43B 3/44*** | (2022.01) |
| ***A43B 3/35*** | (2022.01) |
| ***A43B 7/00*** | (2006.01) |
| ***A43B 7/08*** | (2022.01) |
| ***A43B 7/083*** | (2022.01) |

(52) U.S. Cl.

CPC ..... *A43B 7/083* (2022.01); *A43B 3/35* (2022.01); *A43B 3/44* (2022.01); *A43B 7/005* (2013.01); *A43B 7/088* (2013.01); *A43B 7/081* (2013.01); *A43B 7/082* (2013.01)

(58) Field of Classification Search

CPC .. A43B 3/44; A43B 3/42; A43B 3/355; A43B 3/34; A43B 7/005; A43B 7/06; A43B 7/081

USPC ..... 36/25 R

See application file for complete search history.

(56) References Cited

U.S. PATENT DOCUMENTS

| | | | | |
|---|---|---|---|---|
| 5,367,788 | A * | 11/1994 | Chen | A43B 3/34 36/2.6 |
| 5,918,381 | A * | 7/1999 | Landry | A43B 7/005 36/3 R |
| 6,725,571 | B2 * | 4/2004 | Liu | A43B 1/0045 36/3 R |
| 8,209,882 | B2 * | 7/2012 | Leimer | A43B 17/08 36/3 R |
| 11,357,282 | B2 * | 6/2022 | Cohen | A43B 3/35 |
| 2005/0235523 | A1 * | 10/2005 | Flechsig | A43B 13/182 36/3 R |
| 2010/0005687 | A1 * | 1/2010 | Ramadoro (An) | A43B 7/082 36/29 |

* cited by examiner

*Primary Examiner* — Timothy K Trieu

(57) ABSTRACT

A temperature-adjustment shoe sole, including a supporting member. The supporting member is provided with an air guide channel. A semiconductor temperature control unit, wherein the semiconductor temperature control unit is arranged in the supporting member. The semiconductor temperature control unit has a first temperature control end and a second temperature control end. The first temperature control end of the semiconductor temperature control unit is in contact with an air fluid in an accommodating space to generate a first air fluid. The second temperature control end of the semiconductor temperature control unit is in contact with the air fluid in the accommodating space to generate a second air fluid.

11 Claims, 8 Drawing Sheets

TEMPERATURE-ADJUSTMENT SHOE SOLE

TECHNICAL FIELD

The present disclosure relates to the technical field of shoes, and in particular, to a temperature-adjustment shoe sole.

BACKGROUND OF THE INVENTION

With the improvement of the living standard of people, consumers have increasingly high requirements for the comfort level of wearing shoes, hats, and clothing. For example, for shoes, in addition to requiring comfortable fit, the consumers also have higher requirements for the dryness and breathability of the shoes.

In the hot summer, as the outside air temperature increases, the temperatures inside the shoes also increase. If heat and moisture generated inside the shoes cannot be discharged in time, they will bring a strong sense of discomfort to a wearer and easily lead to a series of foot diseases. Although some shoes are made more breathable by using breathable meshes on shoe uppers, these shoes have low ventilation efficiency and poor cooling and moisture discharging effects, cannot keep a relatively stable temperature and humidity of an air fluid inside the shoes, and cannot keep the shoes dry and comfortable. In the cold winter, as the outside air temperature decreases, the temperatures in the shoes also decrease. If heat lost inside the shoes cannot be supplemented in time, it will bring a strong sense of discomfort to a wearer and easily cause cold feet. Although some shoes are made warmer by arranging thermal insulation materials inside the shoes, these shoes will be soaked with sweat, have low ventilation efficiency and poor cooling and moisture discharging effects, and cannot keep a relatively stable temperature and humidity of an air fluid inside the shoes, and cannot keep the shoes dry and comfortable.

Therefore, the present disclosure provides a temperature-adjustment shoe sole.

SUMMARY OF THE INVENTION

To overcome the shortcomings in the prior art, the present disclosure provides a temperature-adjustment shoe sole, which has a simple structure and can effectively keep a relatively stable temperature and humidity of an air fluid inside the shoes and keep the shoes dry and comfortable.

The technical solution adopted by the present disclosure to solve the technical problem is as follows.

A temperature-adjustment shoe sole, comprising:

a supporting member, wherein the supporting member is provided with an accommodating space and an air guide channel communicated with the accommodating space;

a temperature control assembly, wherein the temperature control assembly includes a semiconductor temperature control unit and an air fluid distribution device; the semiconductor temperature control unit is configured to manufacture a first air fluid and a second air fluid; and the air fluid distribution device is configured to divert the first air fluid into a shoe body through an air guide channel communicated with the accommodating space.

As an improvement of the present disclosure, the semiconductor temperature control unit is arranged in the accommodating space of the supporting member; the semiconductor temperature control unit has a first temperature control end and a second temperature control end; the first temperature control end of the semiconductor temperature control unit is in contact with the air fluid in the accommodating space, thereby cooling or heating the air fluid; and the second temperature control end of the semiconductor temperature control unit is in contact with the air fluid in the accommodating space, thereby heating or cooling the air fluid.

As an improvement of the present disclosure, the fluid distribution device is arranged in the accommodating space of the supporting member, and works to divert the first air fluid treated by the first temperature control end of the semiconductor temperature control unit into the shoe body and to divert the second air fluid treated by the second temperature control end of the semiconductor temperature control unit to the outside of the shoe body, thereby maintaining a relatively stable temperature and humidity of the air fluid inside the shoe body.

As an improvement of the present disclosure, the first temperature control end of the semiconductor temperature control unit faces a top of the shoe sole, and the second temperature control end faces a bottom of the shoe sole, so that during diversion of the first air fluid and the second air fluid, the first air fluid is maintained above the second air fluid.

As an improvement of the present disclosure, the semiconductor temperature control unit is coupled with a second conduction unit, and the second conduction unit includes a second coupling end coupled to the second temperature control end of the semiconductor temperature control unit.

As an improvement of the present disclosure, the air fluid distribution device includes a first fan; and the first fan is configured to divert the first air fluid into the shoe body through the air guide channel.

As an improvement of the present disclosure, the air fluid distribution device includes a second fan; and the second fan is configured to divert the second air fluid to the outside of the shoe body.

As an improvement of the present disclosure, when a power supply of the semiconductor temperature control unit is positively connected, the first temperature control end of the semiconductor temperature control unit is a cooling end, and the second temperature control end is a heating end; and when the power supply of the semiconductor temperature control unit is negatively connected, the first temperature control end of the semiconductor temperature control unit is the heating end, and the second temperature control end is the cooling end.

As an improvement of the present disclosure, the shoe sole further includes a supporting insole and a supporting member surface cover which are arranged at the top of the shoe sole; the supporting member surface cover is provided with an upper surface suction port and an upper surface exhaust port of the shoe sole; the supporting insole and the supporting member surface cover are coupled to form a hollow layer for air circulation; the hollow layer is configured to redistribute the first air fluid flowing out of the air guide channel and into the shoe body through the upper surface exhaust port, so that the first air fluid is more uniformly distributed inside the shoe body; and the upper surface suction port is provided with a dust-proof net.

As an improvement of the present disclosure, the shoe sole further includes a water-cooling heat dissipation device for assisting in heat dissipation or cold dissipation; the accommodating space includes a first accommodating space and a second accommodating space; the first accommodating space is configured to accommodate the temperature control assembly; and the second accommodating space is used to accommodate the water-cooling heat dissipation device.

As an improvement of the present disclosure, the supporting member is provided with a side exhaust port and a side suction port; the side exhaust port is communicated to the first accommodating space to discharge the second air fluid; the side suction port is communicated to the first accommodating space to suck an air fluid in an environment; and the side suction port is provided with a dust-proof net.

As an improvement of the present disclosure, a main control circuit board and a power supply are further arranged in the shoe sole; and the power supply is detachable.

As an improvement of the present disclosure, the supporting member is provided with a temperature sensing device; the temperature sensing device is configured to detect a temperature in a storage space; the temperature sensing device is controlled by a preset program in a mobile terminal; and the preset program automatically adjusts power of the temperature adjustment assembly according to a data change fed back by the temperature sensing device.

As an improvement of the present disclosure, a shoe, comprising the shoe sole improved by the present invention is provided.

Beneficial effects: through the arrangement of the above structure, during use, a first temperature control end of the semiconductor temperature control unit is in contact with an air fluid in the accommodating space to generate a first air fluid. A second temperature control end of the semiconductor temperature control unit is in contact with the air fluid in the accommodating space to generate a second air fluid. The air fluid distribution device is provided. The fluid distribution device is arranged in the supporting member, and works to divert the first air fluid treated by the first temperature control end of the semiconductor temperature control unit into a shoe body and to divert the second air fluid treated by the second temperature control end of the semiconductor temperature control unit to the outside of the shoe body, thereby maintaining a relatively stable temperature and humidity of the air fluid inside the shoe body to make the user feel cold/warm and comfortable in the feet and enhancing the user experience. In addition, the semiconductor temperature control unit has a very small thermal inertia, so that the cooling and heating time is short, which can quickly achieve cooling and heating. Moreover, the semiconductor temperature control unit does not use a refrigerant for cooling, so that it is pollution-free and safe to use, and has low noise and long life.

BRIEF DESCRIPTION OF DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work. In addition, the accompanying drawings are not drawn to a scale of 1:1, and the relative dimensions of the various elements are only shown as examples in the diagrams, not necessarily drawn to a true scale.

The present disclosure is further described below in detail in combination with the accompanying drawings and embodiments.

DETAILED DESCRIPTION OF THE INVENTION

Figure 1:
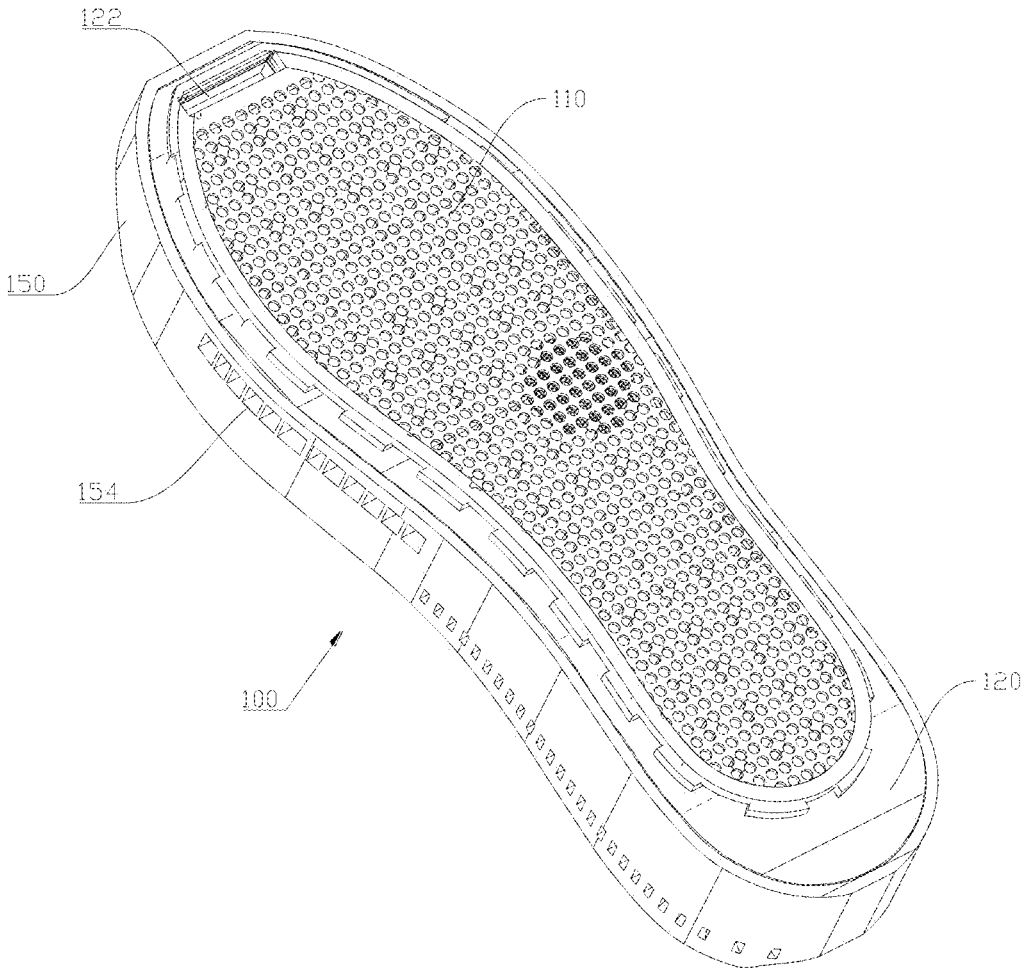
FIG. 1 is a schematic diagram of an entire structure of an insole in one angle according to the present disclosure.

To make the aforementioned objectives, features, and advantages of the present disclosure more comprehensible, specific implementations of the present disclosure are described in detail below in conjunction with the accompanying drawings. In the following description, numerous specific details are set forth to provide a thorough understanding of the present disclosure. The present disclosure may, however, be embodied in many forms different from that described here. A person skilled in the art can make similar improvements without departing from the connotation of the present disclosure. Therefore, the present disclosure is not limited by the specific embodiments disclosed below.

In the description of the present disclosure, It is to be understood that, The terms "center", "longitudinal", "transverse", "upper", "lower", "front", "rear", "left", "right", "vertical", "horizontal", "top", "bottom", "inner", "outer", "clockwise", "counterclockwise", and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure.

In addition, the terms "first" and "second" are used for descriptive purposes only, while not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In addition, the terms "install", "arrange", "provide", "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For ordinary technical personnel in this field, the specific meanings of the above terms in present disclosure can be understood based on specific circumstances.

In the present disclosure, unless specific regulation and limitation otherwise, the first feature "onto" or "under" the second feature may include the direct contact of the first feature and the second feature, or may include the contact of the first feature and the second feature through other features between them instead of direct contact. Moreover, the first feature "onto", "above" and "on" the second feature includes that the first feature is right above and obliquely above the second feature, or merely indicates that the horizontal height of the first feature is higher than the second feature. The first feature "under", "below" and "down" the second feature includes that the first feature is right above and obliquely above the second feature, or merely indicates that the horizontal height of the first feature is less than the second feature.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Figure 2:
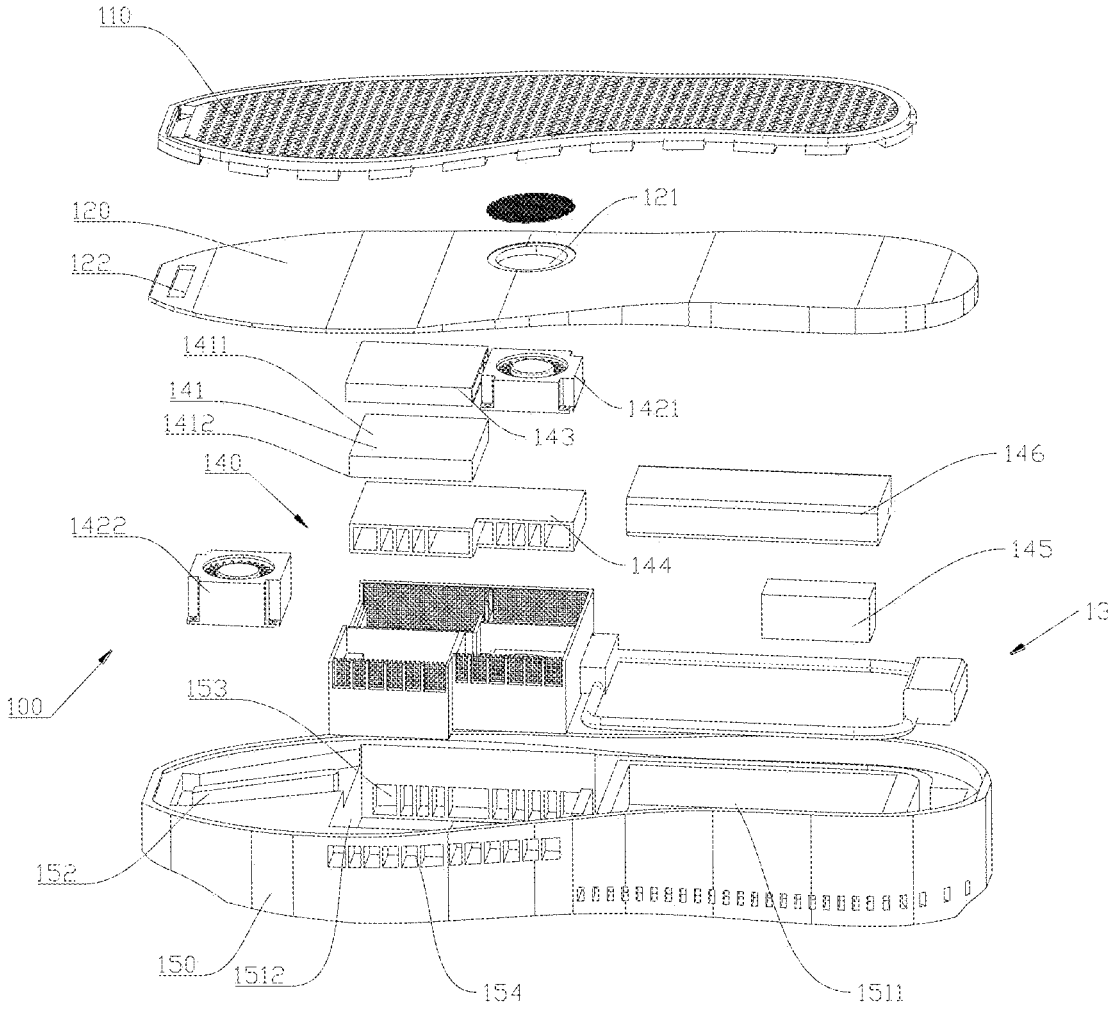
FIG. 2 is a structural exploded diagram of an insole in one angle according to the present disclosure.
Figure 3:
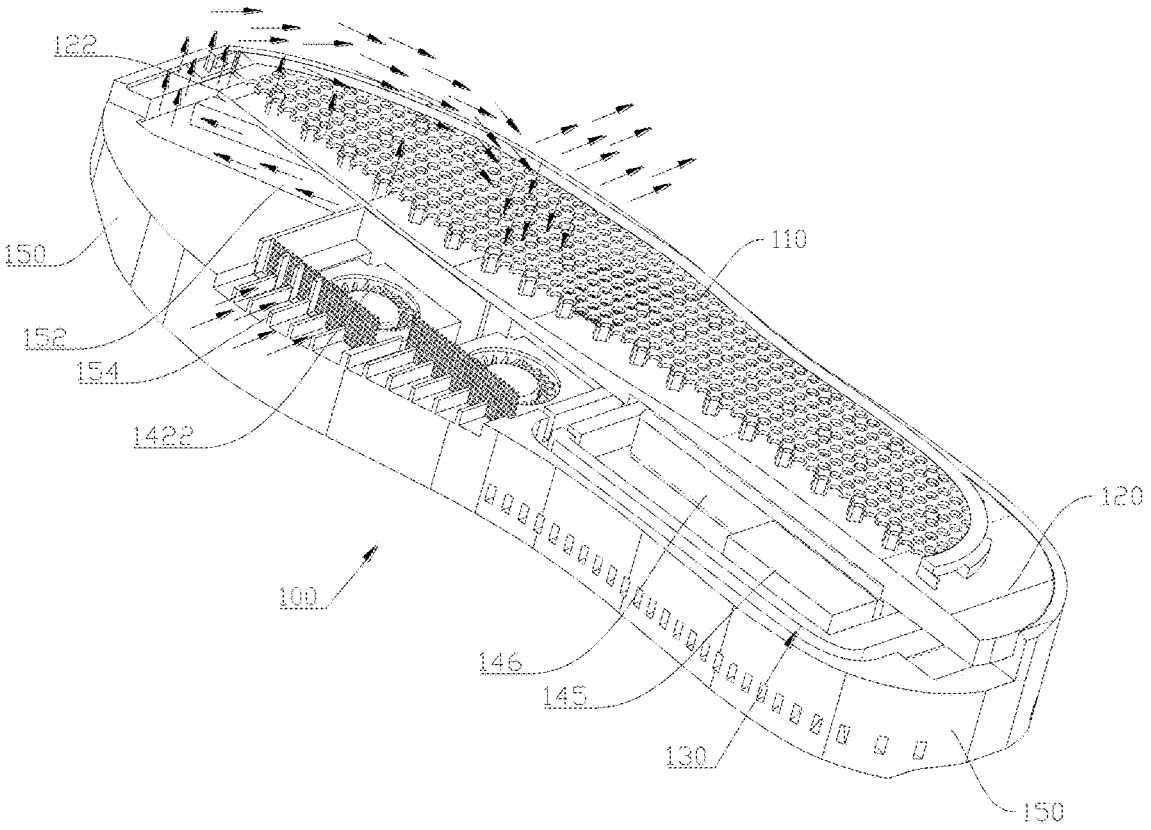
FIG. 3 is a schematic diagram of circulation of an air fluid in a shoe sole in a first angle according to the present disclosure.
Figure 4:
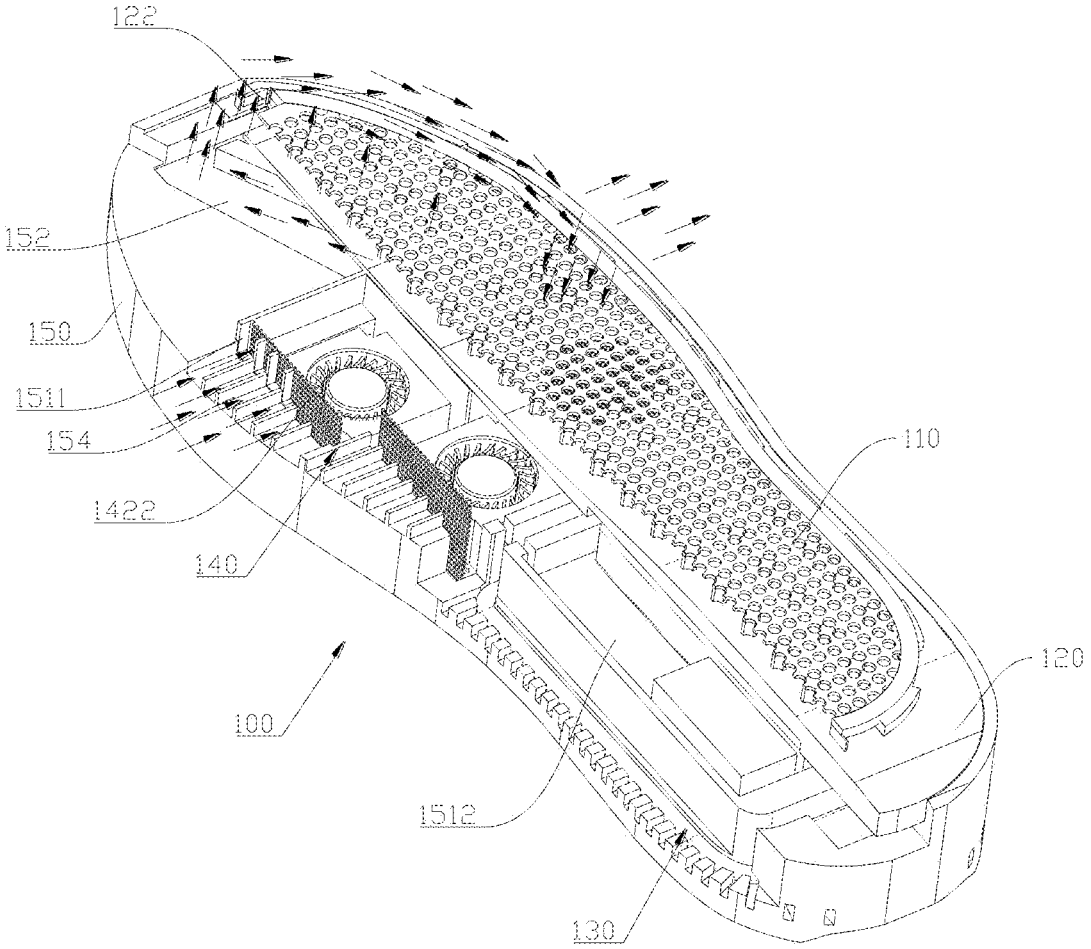
FIG. 4 is a schematic diagram of circulation of an air fluid in a shoe sole in a second angle according to the present disclosure.
Figure 5:
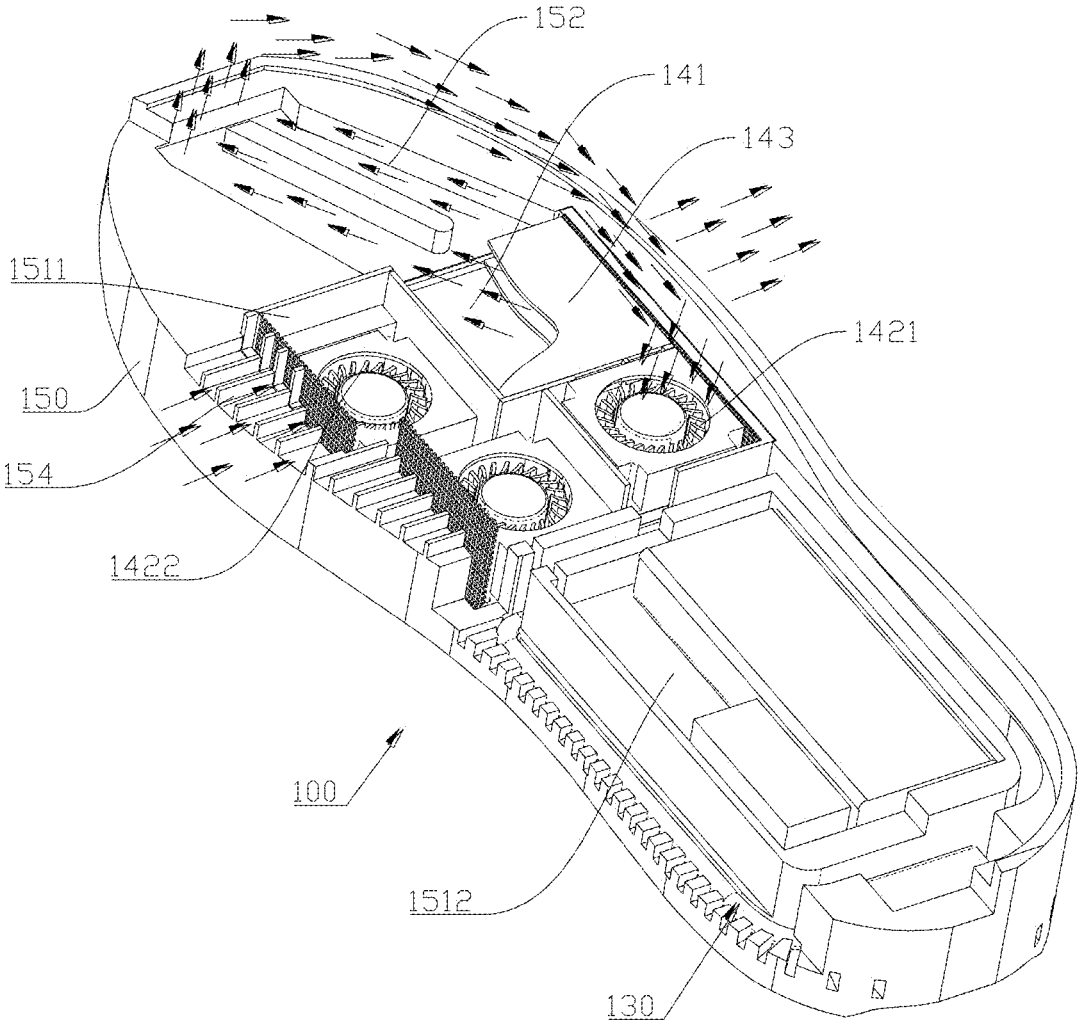
FIG. 5 is a schematic diagram of circulation of an air fluid in a shoe sole in a third angle according to the present disclosure.
Figure 6:
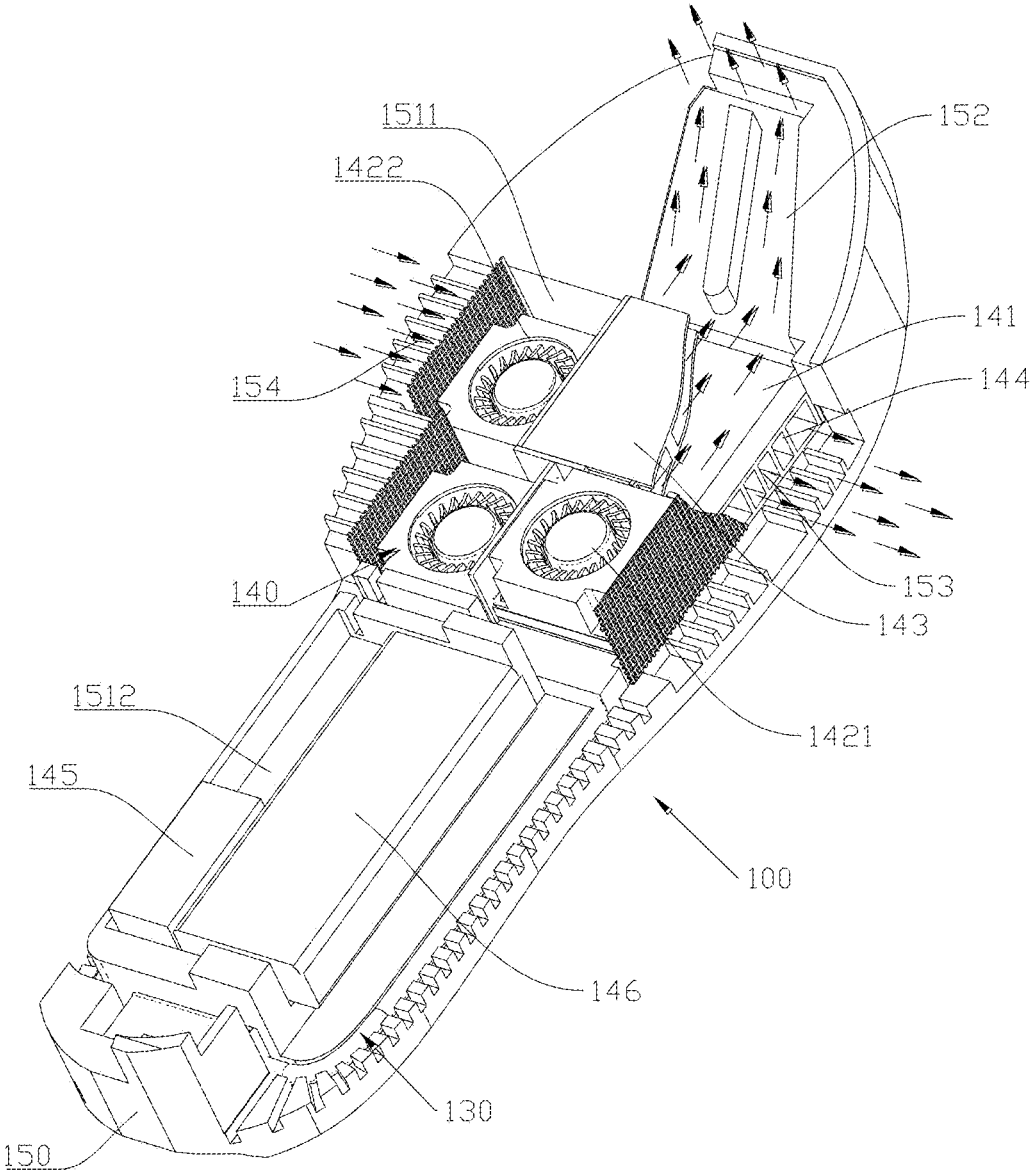
FIG. 6 is a schematic diagram of circulation of an air fluid in a shoe sole in a fourth angle according to the present disclosure.
Figure 7:
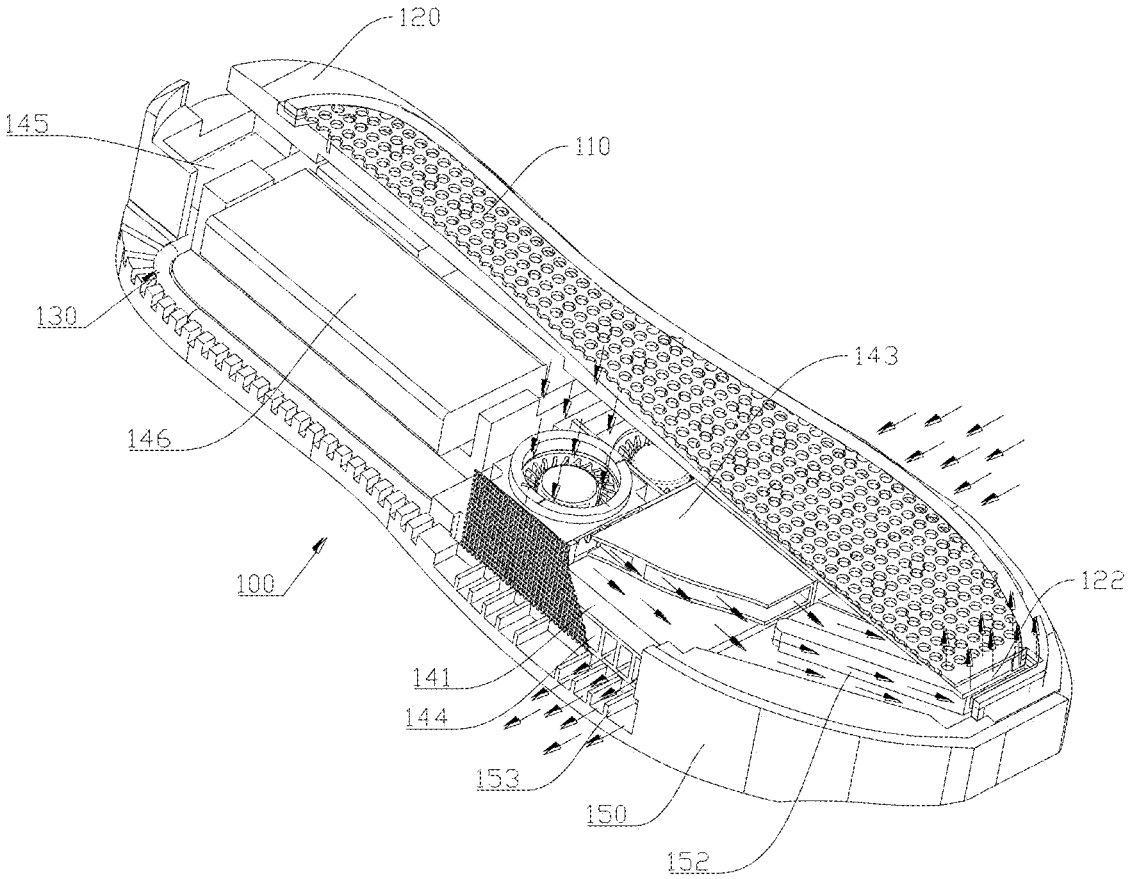
FIG. 7 is a schematic diagram of circulation of an air fluid in a shoe sole in a fifth angle according to the present disclosure.
Figure 8:
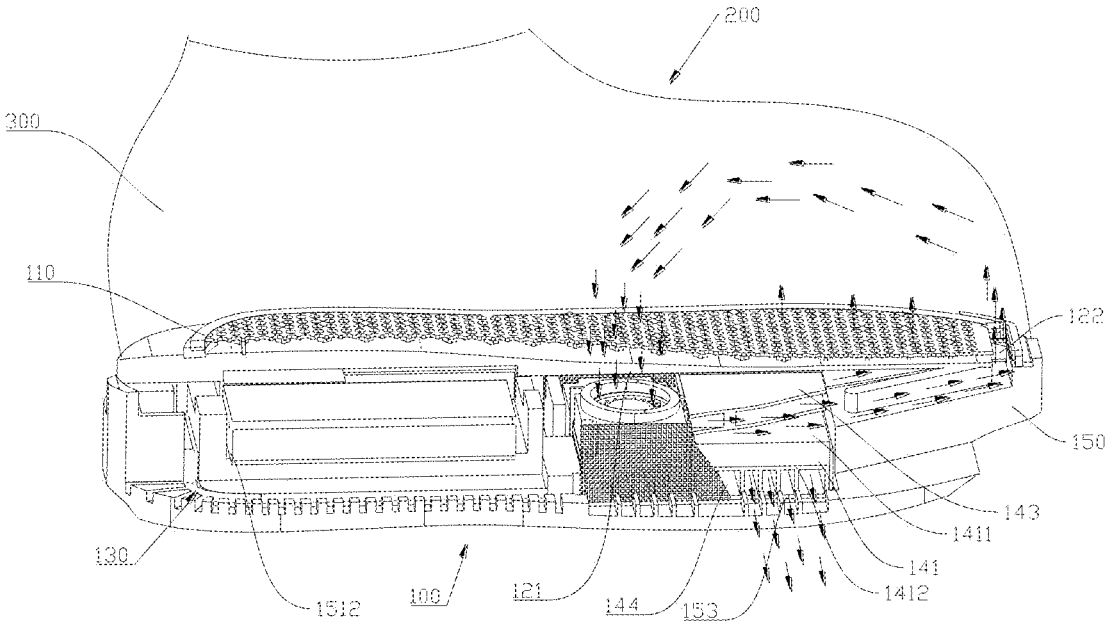
FIG. 8 is a schematic diagram of circulation of an air flow in a shoe in a first angle according to the present disclosure.

Referring to FIG. 1 to FIG. 8, a temperature-adjustment shoe sole includes:

a supporting member 150, wherein the supporting member 150 is provided with an accommodating space 151 and an air guide channel 152 communicated with the accommodating space 151;

a temperature control assembly 140, wherein the temperature control assembly 140 includes a semiconductor temperature control unit 141 and an air fluid distribution device 142; the semiconductor temperature control unit 141 is configured to manufacture a first air fluid and a second air fluid; and the air fluid distribution device 142 is configured to divert the first air fluid into a shoe body through an air guide channel 152 communicated with the accommodating space 151.

Through the arrangement of the above structure, during use, a first temperature control end 1411 of the semiconductor temperature control unit 141 is in contact with an air fluid in the accommodating space to generate a first air fluid. A second temperature control end 1412 of the semiconductor temperature control unit 141 is in contact with the air fluid in the accommodating space to generate a second air fluid. The air fluid distribution device 142 is provided. The fluid distribution device 142 is arranged in the supporting member 150, and works to divert the first air fluid treated by the first temperature control end 1411 of the semiconductor temperature control unit 141 into a shoe body and to divert the second air fluid treated by the second temperature control end 1412 of the semiconductor temperature control unit 141 to the outside of the shoe body, thereby maintaining a relatively stable temperature and humidity of the air fluid inside the shoe body and enhancing the user experience.

In this embodiment, the semiconductor temperature control unit 141 is arranged in the accommodating space 151 of the supporting member 150; the semiconductor temperature control unit 141 has a first temperature control end 1411 and a second temperature control end 1412; the first temperature control end 1411 of the semiconductor temperature control unit 141 is in contact with the air fluid in the accommodating space, thereby cooling or heating the air fluid; and the second temperature control end 1412 of the semiconductor temperature control unit 141 is in contact with the air fluid in the accommodating space 151, thereby heating or cooling the air fluid. Through the arrangement of the above structure, during use, when a power supply of the semiconductor temperature control unit is positively connected, the first temperature control end 1411 of the semiconductor temperature control unit 141 is in contact with the air flow in the accommodating space, thereby cooling the air fluid. The obtained first air fluid is a cold air fluid. The second temperature control end 1412 of the semiconductor temperature control unit 141 is in contact with the air fluid in the accommodating space 151, thereby heating the air fluid. The obtained second air fluid is a hot air fluid. When the power supply of the semiconductor temperature control unit 141 is negatively connected, the first temperature control end 1411 of the semiconductor temperature control unit 141 is in contact with the air flow in the accommodating space, thereby heating the air fluid. The obtained first air fluid is a hot air fluid. The second temperature control end 1412 of the semiconductor temperature control unit 141 is in contact with the air fluid in the accommodating space 151, thereby cooling the air fluid. The obtained second air fluid is a cold air fluid. A user can freely switch the power supply to be positively connected or negatively connected according to an own need, thereby keeping a relatively stable temperature and humidity of the air fluid inside the shoe body, to make the user feel cold/warm and comfortable in the feet. The user experience is further enhanced.

In this embodiment, the fluid distribution device is arranged in the accommodating space 151 of the supporting member 150, and works to divert the first air fluid treated by the first temperature control end 1411 of the semiconductor temperature control unit 141 into the shoe body and to divert the second air fluid treated by the second temperature control end 1412 of the semiconductor temperature control unit 141 to the outside of the shoe body, thereby maintaining a relatively stable temperature and humidity of the air fluid inside the shoe body. Through the arrangement of the above structure, during use, the first air fluid (which may be the cold air fluid or the hot air fluid, and can be adjusted according to a need) treated by the first temperature control end 1411 of the semiconductor temperature control unit 141 is diverted to a storage space 300 inside the shoe body through the air guide channel 152. The second air fluid (which may be the hot air fluid or the cold air fluid and have an opposite temperature property to the first air fluid) treated by the second temperature control end 1412 of the semiconductor temperature control unit 141 is diverted to the outside of the shoe body, thereby maintaining a relatively stable temperature and humidity of the air fluid inside the shoe body, to make the user feel cool/warm and comfortable in the feet. The user experience is further enhanced.

In this embodiment, the first temperature control end 1411 of the semiconductor temperature control unit 141 faces a top of the shoe sole, and the second temperature control end 1412 faces a bottom of the shoe sole, so that a first conduction unit 143 coupled with the first temperature control end 1411 is arranged above a second conduction unit 144 coupled with the second temperature control end 1412. Therefore, during the diversion of the first air fluid and the second air fluid, the first air fluid is maintained above the second air fluid. Through the arrangement of the above structure, during use, the first temperature control end 1411 of the semiconductor temperature control unit 141 faces the top of the shoe sole, and the second temperature control end 1412 faces the bottom of the shoe sole, so that the first conduction unit 143 coupled with the first temperature control end 1411 is arranged above the second conduction unit 144 coupled with the second temperature control end 1412. Therefore, during the diversion of the first air fluid and the second air fluid, the first air fluid is always maintained below the second air fluid. The fluid distribution device works to divert the first air fluid generated by the first temperature control end 1411 of the semiconductor temperature control unit 141 into the shoe body and to divert the second air fluid generated by the second temperature control end 1412 of the semiconductor temperature control unit 141 to the outside of the shoe body, to form an isolation layer for the first air fluid, thereby keeping a relatively stable temperature and humidity of the air fluid inside the shoe body, to make the user feel cool/warm and comfortable in the feet. The user experience is further enhanced.

In this embodiment, the semiconductor temperature control unit 141 is coupled with the first conduction unit 143 and the second conduction unit 144. The first conduction unit 143 includes a first coupling end coupled to the first temperature control end 1411 of the semiconductor temperature control unit 141, and the second conduction unit 144 includes a second coupling end coupled to the second temperature control end 1412 of the semiconductor temperature control unit 141. Through the arrangement of the above structure, during use, when the power supply of the semiconductor temperature control unit 141 is positively connected, heat of the first coupling end of the first conduction unit 143 coupled to the first temperature control end 1411 of the semiconductor temperature control unit 141 is quickly absorbed by the first temperature control end 1411 of the semiconductor temperature control unit 141. Furthermore, through heat conduction, a portion of the first conduction unit 143 that is in contact with the air fluid is quickly cooled and absorbs heat from the air fluid, thereby improving the efficiency of cooling the air fluid by the semiconductor temperature control unit 141. The second coupling end coupled to the second temperature control end 1412 of the semiconductor temperature control unit 141 quickly absorbs the heat generated by the second temperature control end 1412 of the semiconductor temperature control unit 141, and forms the hot air fluid through the heat conduction. The hot air fluid is then diverted to the outside of the shoe body through the air fluid distribution device 142, thereby maintaining a relatively stable temperature and humidity of the air fluid inside the shoe body to make the user feel cool/warm and comfortable in the feet. The user experience is further enhanced. When the power supply of the semiconductor temperature control unit 141 is negatively connected, the process is similar, except that the first conduction unit 143 changes from cooling to heating, and the second conduction unit 144 changes from heating to cooling.

In this embodiment, the air fluid distribution device 142 includes a first fan 1421 configured to divert the first air fluid into the shoe body through the air guide channel 152, and a second fan 1422 configured to divert the second air fluid to the outside of the shoe body through a side exhaust port. Through the arrangement of the above structure, during use, the first fan 1421 diverts the first air fluid formed by the first temperature control end 1411 of the semiconductor temperature control unit 141 into the shoe body, and the second fan 1422 diverts the second air fluid formed by the second temperature control end 1412 of the semiconductor temperature control unit 141 to the outside of the shoe body, thereby better keeping a relatively stable temperature and humidity of the air fluid inside the shoe body, to make the user feel cool/warm and comfortable in the feet. The user experience is further enhanced.

In this embodiment, when a power supply of the semiconductor temperature control unit 141 is positively connected, the first temperature control end 1411 of the semiconductor temperature control unit 141 is a cooling end, and the second temperature control end 1412 is a heating end; and when the power supply of the semiconductor temperature control unit 141 is negatively connected, the first temperature control end 1411 of the semiconductor temperature control unit 141 is the heating end, and the second temperature control end 1412 is the cooling end. Through the arrangement of the above structure, during use, it is possible to switch the first temperature control end 1411 of the semiconductor temperature control unit 141 to achieve cooling or heating according to a need, so that the first air fluid flowing into the storage space 300 of the shoe body can be either the cold air fluid or the hot air fluid, thereby better maintaining a relatively stable temperature and humidity of the air fluid inside the shoe body, to make the user feel cool/warm and comfortable in the feet. The user experience is further enhanced.

In this embodiment, the shoe sole further includes a supporting insole 110 and a supporting member surface cover 120 which are arranged at the top of the shoe sole; the supporting member surface cover 120 is provided with an upper surface suction port 121 and an upper surface exhaust port 122 of the shoe sole; the insole 110 and the supporting member surface cover 120 are coupled to form a hollow layer for air circulation; the hollow layer is configured to redistribute the first air fluid flowing out of the air guide channel 152 and into the shoe body through the upper surface exhaust port 122, so that the first air fluid is more uniformly distributed inside the shoe body; and the upper surface suction port 121 is provided with a dust-proof net. Through the arrangement of the above structure, during use, the supporting insole 110 and the supporting member surface cover 120 which are arranged at the top of the shoe sole are coupled to form the hollow layer for air circulation, so that the first air fluid flowing into the shoe body from the air guide channel 152 flows into the shoe body more uniformly through the hollow layer for air circulation from small holes provided in the supporting insole 110, thereby better maintaining a relatively stable temperature and humidity of the air fluid inside the shoe body, to make the user feel cool/warm and comfortable in the feet. The user experience is enhanced. The upper surface suction port 121 is provided with a dust-proof net, which can prevent impurities such as gravels from entering a circulation channel of the air fluid, thereby ensuring the smoothness of the circulation channel of the air fluid and further improving the user experience.

In this embodiment, the shoe sole further includes a water-cooling heat dissipation device 130 to assist in heat dissipation. Through the arrangement of the above structure, the water-cooling heat dissipation device 130 arranged on the shoe sole is configured to assist the second conduction unit in dissipating heat or cold to improve heat or cold dissipation efficiency, thereby better maintaining a relatively stable temperature and humidity of the air fluid inside the shoe body and further enhancing the user experience.

In this embodiment, the accommodating space includes a first accommodating space 1511 and a second accommodating space 1512; the first accommodating space 1511 is configured to accommodate the temperature control assembly 140; and the second accommodating space 1512 is used to accommodate the water-cooling heat dissipation device 130. Through the arrangement of the above structure, during use, the temperature control assembly 140 arranged in the first accommodating space 1511 cooperates with the water-cooling heat dissipation device 130 arranged in the second accommodating space 1512 to further improve the temperature control efficiency, thereby better maintaining a relatively stable temperature and humidity of the air fluid inside the shoe body, to make a user feel cool and comfortable more uniformly in the feet. The user experience is further enhanced.

In this embodiment, the supporting member 150 is provided with a side exhaust port 153 and a side suction port 154; the side exhaust port 153 is communicated to the first accommodating space 1511 to discharge the second air fluid; the side suction port 154 is communicated to the first accommodating space 1511 to suck an air fluid in an environment; and the side suction port 154 is provided with a dust-proof net. Through the arrangement of the above structure, during use, the undesired second air fluid is discharged into the air through the side exhaust port 153, and the air fluid in the environment is sucked in through the side suction port 154, thereby improving the heat or cold dissipation efficiency of the second conduction unit 144 and better maintaining a relatively stable temperature and humidity of the air fluid inside the shoe body, to make a user feel cool and comfortable more uniformly in the feet. The user experience is further enhanced. The side suction port 154 is provided with a dust-proof net, which can prevent impurities such as gravels from entering a circulation channel of the air fluid, thereby ensuring the smoothness of the circulation channel of the air fluid and further improving the user experience.

In this embodiment, a main control circuit board 145 and a power supply 146 are further arranged in the shoe sole. The power supply 146 is detachable. By the arrangement of the above structure, during use, the main control circuit board 145 and the power supply 146 are mounted in the accommodating space 151 of the supporting member 150. The power supply 146 is electrically connected to the main control circuit board 145 and the temperature control assembly 140 and provides electrical energy to the through the temperature control assembly 140. The temperature control assembly 140 converts the electrical energy into mechanical energy for rotation of the first fan 1421 and the second fan 1422, and adjusts the distribution of the air fluid in the shoe, so that good ventilation, sweat discharging, and cooling effects are achieved, and the user experience is further enhanced. The power supply 146 can use a lithium battery with a high energy density, to reduce the charging frequency of a user. Meanwhile, the weight of the battery is reduced, and the user experience is further enhanced. The power supply 146 is detachable. Therefore, the depleted power supply 146 can be replaced at any time by a backup power supply, and the depleted power supply 146 is conveniently connected to a power supply for charging without taking off the shoe, thereby further enhancing the user experience.

In this embodiment, the supporting member 150 is provided with a temperature sensing device. The temperature sensing device is configured to detect a temperature in a storage space 300. The temperature sensing device is controlled by a preset program in a mobile terminal. The preset program automatically adjusts power of the semiconductor temperature control unit 141 according to a data change fed back by the temperature sensing device. The preset program controls the temperature of the air fluid in the storage space 300 in the shoe through the following steps:

Step I: A user enters a control mini program and selects a cooling mode or a heating mode.

Step II: After the mode is selected, the user sets a target temperature X through the mini program.

Step III: The temperature sensing device detects the temperature of the air fluid in the storage space in the shoe.

If the cooling mode is selected, the following steps will be continued to be executed:

Step IV: When the temperature of the air fluid in the storage space 300 in the shoe is less than X+1 degrees, the semiconductor temperature control unit 141 is automatically turned on at first power to adjust the temperature of the air fluid in the storage space 300 in the shoe. When the temperature of the air fluid in the storage space 300 in the shoe is greater than or equal to X+1 degrees and less than X+3 degrees, the semiconductor temperature control unit 141 is automatically turned on at fifth power to adjust the temperature of the air fluid in the storage space 300 in the shoe. When the temperature of the air fluid in the storage space 300 in the shoe is greater than or equal to X+3 degrees, the semiconductor temperature control unit 141 is automatically turned on at tenth power to adjust the temperature of the air fluid in the storage space 300 in the shoe. When the temperature of the air fluid in the storage space 300 in the shoe is less than X−2 degrees, the semiconductor temperature control unit 141 is turned off.

Step V: The temperature sensing device continuously detects the temperature of the air fluid in the accommodating space in the shoe, and feeds back detected temperature data to the preset program. The preset program cyclically executes step IV.

If the heating mode is selected, the following steps will be continued to be executed:

Step VI: When the temperature of the air fluid in the storage space 300 in the shoe is less than X+1 degrees, the semiconductor temperature control unit 141 is automatically turned on at first power to adjust the temperature of the air fluid in the storage space 300 in the shoe. When the temperature of the air fluid in the storage space 300 in the shoe is greater than or equal to X+1 degrees and less than X+3 degrees, the semiconductor temperature control unit 141 is automatically turned on at fifth power to adjust the temperature of the air fluid in the storage space 300 in the shoe. When the temperature of the air fluid in the storage space 300 in the shoe is greater than or equal to X+3 degrees, the semiconductor temperature control unit 141 is automatically turned on at tenth power to adjust the temperature of the air fluid in the storage space 300 in the shoe. When the temperature of the air fluid in the storage space 300 in the shoe is greater than X+2 degrees, the semiconductor temperature control unit 141 is turned off.

Step VII: The temperature sensing device continuously detects the temperature of the air fluid in the accommodating space in the shoe, and feeds back detected temperature data to the preset program. The preset program cyclically executes step VI.

In this embodiment, a shoe is provided, including the shoe sole of the present disclosure.

As described above, one or more embodiments are provided in conjunction with the detailed description, The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

The invention claimed is:

1. A temperature-adjustment shoe sole, comprising:

a supporting member, wherein the supporting member is provided with an accommodating space and an air guide channel communicated with the accommodating space;

a temperature control assembly, wherein the temperature control assembly comprises a semiconductor temperature control unit and an air fluid distribution device; the semiconductor temperature control unit is configured to manufacture a first air fluid and a second air fluid; and the air fluid distribution device is configured to divert the first air fluid into a shoe body through an air guide channel communicated with the accommodating space;

wherein the semiconductor temperature control unit is arranged in the accommodating space of the supporting member; the semiconductor temperature control unit has a first temperature control end and a second temperature control end; the first temperature control end of the semiconductor temperature control unit is in contact with the air fluid in the accommodating space, thereby cooling or heating the air fluid; and the second temperature control end of the semiconductor temperature control unit is in contact with the air fluid in the accommodating space, thereby heating or cooling the air fluid;

wherein the fluid distribution device is arranged in the accommodating space of the supporting member, and works to divert the first air fluid treated by the first temperature control end of the semiconductor temperature control unit into the shoe body and to divert the second air fluid treated by the second temperature control end of the semiconductor temperature control unit to the outside of the shoe body, thereby maintaining a relatively stable temperature and humidity of the air fluid inside the shoe body;

wherein the first temperature control end of the semiconductor temperature control unit faces a top of the shoe sole, and the second temperature control end faces a bottom of the shoe sole, so that during diversion of the first air fluid and the second air fluid, the first air fluid is maintained above the second air fluid.

2. The temperature-adjustment shoe sole according to claim 1, wherein the first temperature control end of the semiconductor temperature control unit faces a top of the shoe sole, and the second temperature control end faces a bottom of the shoe sole, so that during diversion of the first air fluid and the second air fluid, the first air fluid is maintained above the second air fluid.

3. The temperature-adjustment shoe sole according to claim 2, wherein when a power supply of the semiconductor temperature control unit is positively connected, the first temperature control end of the semiconductor temperature control unit is a cooling end, and the second temperature control end is a heating end; and when the power supply of the semiconductor temperature control unit is negatively connected, the first temperature control end of the semiconductor temperature control unit is the heating end, and the second temperature control end is the cooling end.

4. The temperature-adjustment shoe sole according to claim 2, wherein the shoe sole further comprises a supporting insole and a supporting member surface cover which are arranged at the top of the shoe sole; the supporting member surface cover is provided with an upper surface suction port and an upper surface exhaust port of the shoe sole; the supporting insole and the supporting member surface cover are coupled to form a hollow layer for air circulation; the hollow layer is configured to redistribute the first air fluid flowing out of the air guide channel and into the shoe body through the upper surface exhaust port, so that the first air fluid is more uniformly distributed inside the shoe body; and the upper surface suction port is provided with a dust-proof net.

5. The temperature-adjustment shoe sole according to claim 4, wherein the supporting member is provided with a side exhaust port and a side suction port; the side exhaust port is communicated to the first accommodating space to discharge the second air fluid; the side suction port is communicated to the first accommodating space to suck an air fluid in an environment; and the side suction port is provided with a dust-proof net.

6. The temperature-adjustment shoe sole according to claim 1, wherein the air fluid distribution device comprises a first fan; and the first fan is configured to divert the first air fluid into the shoe body through the air guide channel.

7. The temperature-adjustment shoe sole according to claim 1, wherein the air fluid distribution device comprises a second fan; and the second fan is configured to divert the second air fluid to the outside of the shoe body.

8. The temperature-adjustment shoe sole according to claim 1, wherein the shoe sole further comprises a water-cooling heat dissipation device for assisting in heat dissipation or cold dissipation; the accommodating space comprises a first accommodating space and a second accommodating space; the first accommodating space is configured to accommodate the temperature control assembly; and the second accommodating space is used to accommodate the water-cooling heat dissipation device.

9. The temperature-adjustment shoe sole according to claim 1, wherein a main control circuit board and a power supply are further arranged in the shoe sole; and the power supply is detachable.

10. The temperature-adjustment shoe sole according to claim 1, wherein the supporting member is provided with a temperature sensing device; the temperature sensing device is configured to detect a temperature in a storage space; the temperature sensing device is controlled by a preset program in a mobile terminal; and the preset program automatically adjusts power of the temperature adjustment assembly according to a data change fed back by the temperature sensing device.

11. A shoe, comprising the shoe sole according to claim 1.

* * * * *